US007931547B2

(12) United States Patent
Bishop

(10) Patent No.: US 7,931,547 B2
(45) Date of Patent: Apr. 26, 2011

(54) BASEBALL PITCHER'S EYE TRAINING AND GAME

(76) Inventor: William P. Bishop, San Antonio, TX (US)

( * ) Notice: Subject to any disclaimer, the term of this patent is extended or adjusted under 35 U.S.C. 154(b) by 100 days.

(21) Appl. No.: 11/975,599

(22) Filed: Oct. 20, 2007

(65) Prior Publication Data

US 2008/0293521 A1 Nov. 27, 2008

Related U.S. Application Data

(60) Provisional application No. 60/931,790, filed on May 25, 2007.

(51) Int. Cl.
*A63B 69/00* (2006.01)

(52) U.S. Cl. ..... 473/454; 473/422

(58) Field of Classification Search ..... 473/422, 473/454–456, 431, 432, 435, 197; 273/409, 273/410; D21/780, 699
See application file for complete search history.

(56) References Cited

U.S. PATENT DOCUMENTS

| | | | | | |
|---|---|---|---|---|---|
| 1,043,308 | A | * | 11/1912 | Everson | 473/432 |
| 1,142,184 | A | * | 6/1915 | Lawrence | 473/454 |
| 1,652,062 | A | * | 12/1927 | Stauffer | 473/432 |
| 2,082,818 | A | * | 6/1937 | Atwell | 473/436 |
| 2,978,246 | A | * | 4/1961 | Van Groningen | 473/456 |
| 2,988,360 | A | * | 6/1961 | Lambiotte | 273/396 |
| D211,467 | S | * | 6/1968 | Wilbur | D22/113 |
| 3,583,703 | A | * | 6/1971 | Brown et al. | 473/456 |
| 4,118,028 | A | * | 10/1978 | Larkin | 473/456 |
| 4,204,677 | A | * | 5/1980 | Haggarty | 473/454 |
| 4,244,586 | A | * | 1/1981 | Gorrow | 273/409 |
| 4,643,423 | A | * | 2/1987 | Wright | 473/456 |
| 4,830,369 | A | * | 5/1989 | Poitras | 473/455 |
| D303,824 | S | * | 10/1989 | Maloney, II | D21/699 |
| 4,872,674 | A | * | 10/1989 | Deal | 473/435 |
| 4,974,843 | A | * | 12/1990 | Henningsson | 473/431 |
| 5,351,948 | A | * | 10/1994 | Thomas | 473/417 |
| 5,439,211 | A | * | 8/1995 | Drabowsky | 473/456 |
| 5,485,994 | A | * | 1/1996 | Underwood et al. | 473/451 |
| 5,573,240 | A | * | 11/1996 | Humboldt | 473/454 |
| 5,588,645 | A | * | 12/1996 | Schwan et al. | 473/456 |
| D380,797 | S | * | 7/1997 | Schwan et al. | D21/699 |
| 5,803,842 | A | * | 9/1998 | Ross | 473/456 |
| 6,155,936 | A | * | 12/2000 | Dorr | 473/456 |
| D455,811 | S | * | 4/2002 | Fedio, Jr. | D22/113 |
| 6,379,272 | B1 | * | 4/2002 | Gorgo et al. | 473/421 |
| 6,402,641 | B1 | * | 6/2002 | Lee | 473/446 |
| 6,620,064 | B2 | * | 9/2003 | Nickerson | 473/431 |
| 6,878,078 | B2 | * | 4/2005 | Swanson | 473/454 |
| 6,926,624 | B1 | * | 8/2005 | Witzke | 473/446 |
| D509,872 | S | * | 9/2005 | Alberti | D21/780 |
| 7,066,845 | B2 | * | 6/2006 | Joseph | 473/431 |
| 7,278,934 | B2 | * | 10/2007 | McBride et al. | 473/451 |
| 2002/0123397 | A1 | * | 9/2002 | Brasuell | 473/421 |

* cited by examiner

*Primary Examiner* — Mitra Aryanpour
(74) *Attorney, Agent, or Firm* — Scott D. Compton; The Compton Law Firm, P.C.

(57) ABSTRACT

Provided are articles comprising targets useful in aiding persons desiring to improve their baseball pitching skills. An article according to one embodiment of the invention comprises a target area that corresponds substantially in size with the strike zone in American baseball, and the target area is divided into quadrants each of a contrasting color with respect to one another. A plurality of characters, such as numbers, are disposed about the periphery of the target area.

9 Claims, 4 Drawing Sheets

BASEBALL PITCHER'S EYE TRAINING AND GAME

CROSS-REFERENCES TO RELATED APPLICATIONS

This application claims the benefit of U.S. Provisional Application No. 60/931,790 filed May 25, 2007, the entire contents of each of which are herein incorporated by reference.

TECHNICAL FIELD

This invention relates generally to ocular acuity and hand-to-eye coordination in physical activity. More particularly, it relates to articles and methods useful for improving accuracy in the controlled delivery of projectiles, such as baseballs.

BACKGROUND INFORMATION

The team sport of baseball has been known for over a century, and it is well-known that the position of "pitcher" in the game of baseball is the person who pitches the ball towards the batter. It is also well-known, that the purpose of the pitcher is not to pitch the baseball so that the batter hits the ball and in fact it is desirous for all pitchers to pitch a game in which the opposing team does not obtain a single hit during the entire game. Such an achievement of what is called a "no-hitter" game is possibly only through relatively long-term display of consistent accuracy, power, and stamina in the delivery of baseballs to the strike zone.

As with most human activity, the quality of an individual's performance is increased as the person increases their time investment in practice of the particular activity. This is true with regards to the activity of pitching baseballs. Embodiments of the present invention are concerned with articles and methods for aiding individuals in elevating their level of skill in the delivery of pitched baseballs.

SUMMARY OF THE INVENTION

Provided herein are embodiments of articles useful as a training aid for pitching projectiles such as baseballs. Such articles may comprise: a target area that is substantially rectangular in dimension and having a periphery, and which target area corresponds substantially or exactly in size dimensions and/or proportion to the strike zone in American baseball. There are a pair of sectioning lines which divide the target area into four substantially equal quadrants, with the sectioning lines being reminiscent in orientation about the target area to crosshairs on a rifle scope, each of the quadrants having a background color that is sufficiently different from its adjacent quadrants to provide an effective amount of contrast sufficient to enable a viewer to distinguish between the different quadrants visually from a distance within the throwing ability of the viewer. There is also a plurality of characters disposed about the outer periphery of the target area, wherein the characters may be selected from the group consisting of: numbers, letters, symbols, signs, and geometric shapes.

DETAILED DESCRIPTION

Figure 1:
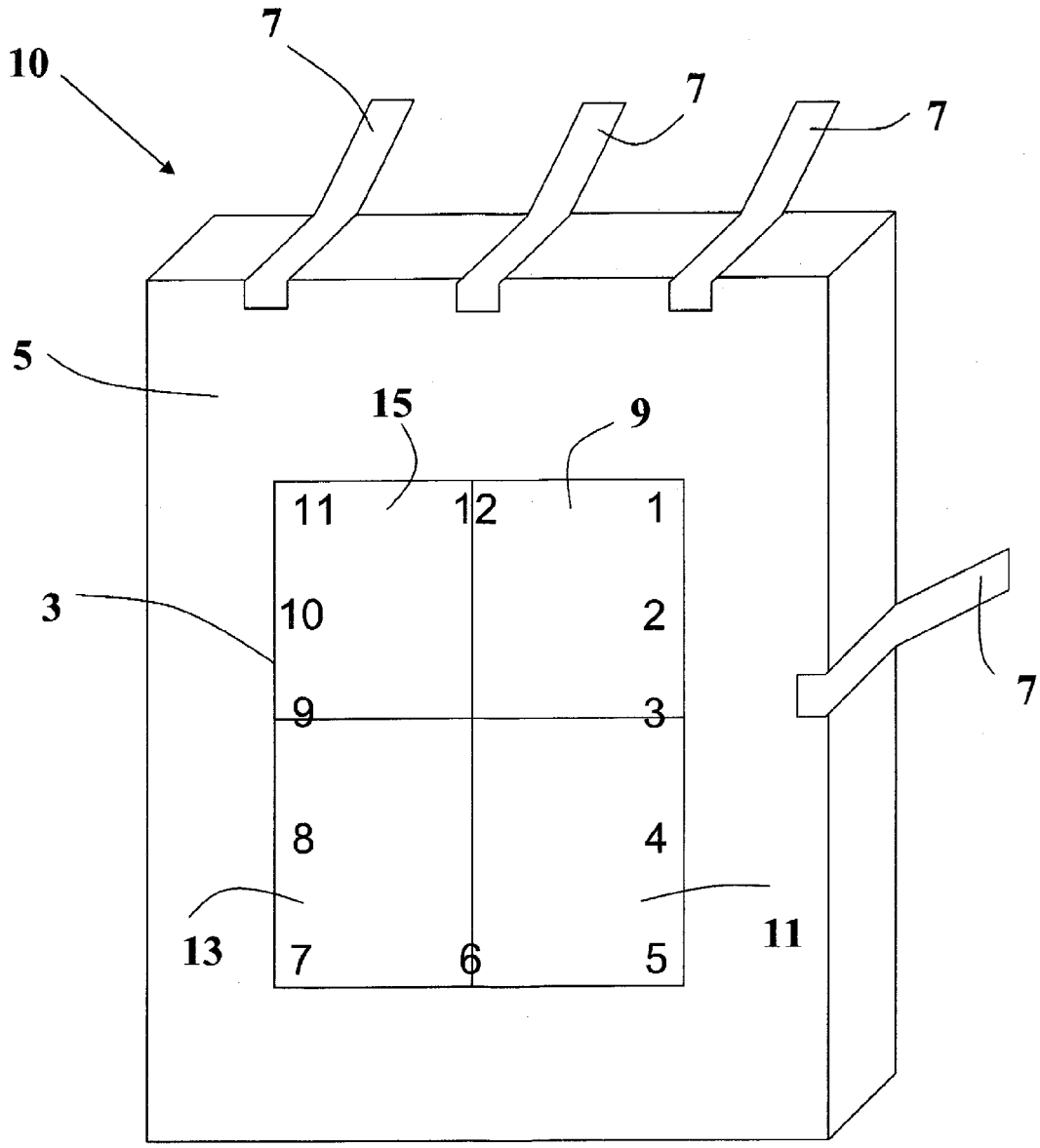
FIG. 1 shows a perspective view of a device comprising a target area useful in accordance with one embodiment of the invention.

Referring to the drawings and initially to FIG. 1 there is shown a perspective view of a device 10 comprising a target area 3 useful in accordance with the invention. The target area 3 in one preferred form of the invention is a rectangular area which itself is sectioned off using lines, as shown, to comprise first quadrant 9, second quadrant 11, third quadrant 13, and fourth quadrant areas or regions. Although a rectangularly-shaped target area 3 is preferable, the invention also includes the employment of target areas 3 which may be of other shapes, including without limitation: circular target areas, oval target areas, triangular target areas, rhombic target areas, trapezoidal target areas, or target areas having the shape of any regular polygon, in addition to irregular shapes, provided that they are sectioned into quadrants having contrasting colors or shades as described herein, which are sufficient to enable a viewer to distinguish adjacent quadrants from one another when poised at a distance of about 30 meters, or any other distance within the person's ability to throw a projectile. In preferred embodiments, the lines used to section the target area 3 into quadrants are oriented as the crosshairs in a rifle scope, at 90 degrees with respect to one another.

The target area 3 may comprise a piece of fabric, such as made from natural fibers including without limitation cottons, linens, burlap, hemp, and the like, and may also comprise sheets of polymeric materials, woven or non-wovens, including polyolefins, nylons, and other known sheet materials. The target area may also be paper or cardboard.

In any event, as mentioned, the target area comprises lines which divide it into a plurality of regions, or quadrants, with each quadrant comprising a different color or shade to provide contrast with respect to the remaining quadrants sufficiently so as to render the quadrants as being visually discernable from one another.

There are also a plurality of individual characters, preferably numbers, disposed and arranged as shown on the target area. In a preferred embodiment, the characters are Arabic-style numerals arranged as on a common clock face, disposed about the periphery of the target area 3. However, the selection of Arabic-style numerals, while being preferred, is but one embodiment of the invention. Alternatives to the use of Arabic-style numerals include, without limitation, geometric shapes such as triangles, stars, rectangles, circles, etc., with the main proviso being that each character selected must be distinguishable from the remaining characters. Accordingly, Roman and other-style numerals or letters may also be used, including the letters or numerals used by any known current or obsolete language.

The colors/shades used, the lines used to section the target area 3 into such quadrants, and the characters (numbers, letters, shapes, etc.) may be collectively referred to as the target area features. The target area features may be silk-screened onto the material chosen from which the target area 3 is comprised. Alternatively, the target area features may be painted onto the material from which the target area 3 is comprised. In another alternative, the target area features may be printed onto the material from which the target area 3 is comprised. The target area features may each be discrete elements, which are each individually adhered to the material from which the target area 3 is comprised, using conventional fastening means, such as adhesives, static electricity, or hook-and-loop fastening means, such as a VELCRO® fastener.

FIG. 1 also depicts a backing 5, which in one embodiment may comprise a slab of a foamed polymer, such as polyurethane foam, polyolefin foam, etc. that is contained within a fabric sheath, so as to resemble a pillow or cushion. This provides a cushioning effect when a user throws a projectile such as a baseball (hardball, regulation hardball, softball, regulation softball), tennis ball, or any other ball at the target area 3. In this embodiment, the target area features may be directly printed, silk-screened, painted, adhered, etc. directly to the backing itself, so as to be of singular construction with it, or the target area features may be disposed on a separate sheet of material such as canvas, sheet nylon, PVC, polyolefin, etc., which sheet is itself then affixed to the backing using conventional means mentioned above, including stitching. Also shown in FIG. 1 are mounting straps 7, which are useful in affixing the device 10 to a stationary object, such as a fence, post, tree, or any other structure capable of supporting the device 10 in a substantially vertical position, so that the numeral 12 is disposed vertically above the numeral 6. The straps may be of any length desired, and may comprise conventional fastening means, including VELCRO® fasteners, belt buckles, snaps, etc. In a preferred embodiment, the target area 3 has the exact shape and dimensions of what is well-known in the art of baseball as "the strike zone." In a preferred use of a device 10 according to the invention, the device 10 is affixed to a stationary object in such fashion as to make the strike zone defined by the target area to reside at substantially the exact location in space with respect to the ground that a real strike zone in an actual baseball game would reside. Such positioning enables a person who desires to practice their pitching skills, to step back from the device 10 at a selected distance, and throw pitches, with the target area 3 being in mind made equivalent to an actual strike zone in a real or practice baseball game. Since a device 10 according to the present invention is intended to have versatility with respect to its vertical placement, the mounting straps 7 may be of any length necessary or desired, and may alternatively be comprised of rope or twine that is stitched or otherwise adhered to any portion of the backing 5.

Figure 2:
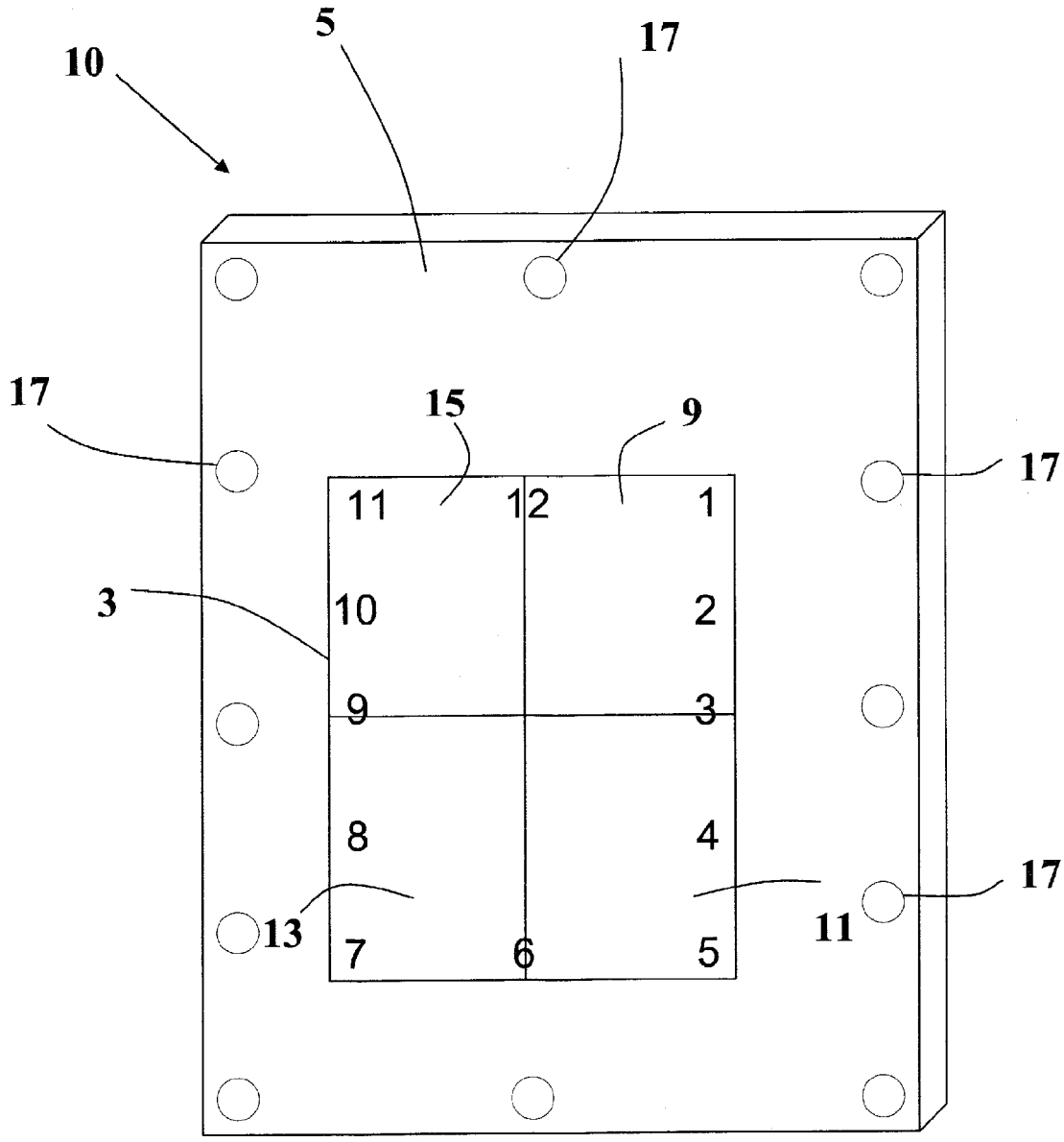
FIG. 2 shows a perspective view of a device comprising a target area useful in accordance with an alternate embodiment of the invention.

FIG. 2 shows a perspective view of an alternate embodiment of a device 10 comprising a target area useful in accordance with the invention. In this embodiment are shown the respective locations of the target area 3, backing 5, first quadrant 9, second quadrant 11, third quadrant 13, and fourth quadrant 15. There are also a plurality of grommets 17 disposed around the perimeter of the backing 5. In this and all embodiments, the backing 5 may comprise a piece of fabric, such as made from natural fibers including without limitation cottons, linens, burlap, hemp, and the like, and may also comprise sheets of polymeric materials, woven or non-wovens, including polyolefins, nylons, and other known sheet materials. The backing may also be paper or cardboard. Thus, the backing 5 may be comprised of the same material as the target area 3. In other embodiments, the backing 5 and target area 3 may each be independently comprised of materials which are different from one another within the aforesaid class of materials. In one embodiment, the sheet or fabric on which the target area features are painted, printed, adhered etc. is different from that of the backing. In another embodiment, the target area features are painted, printed, adhered directly to the backing 5. The grommets 17 provide an easy means for tying or fastening the device 10 to a stationary object.

Figure 3:
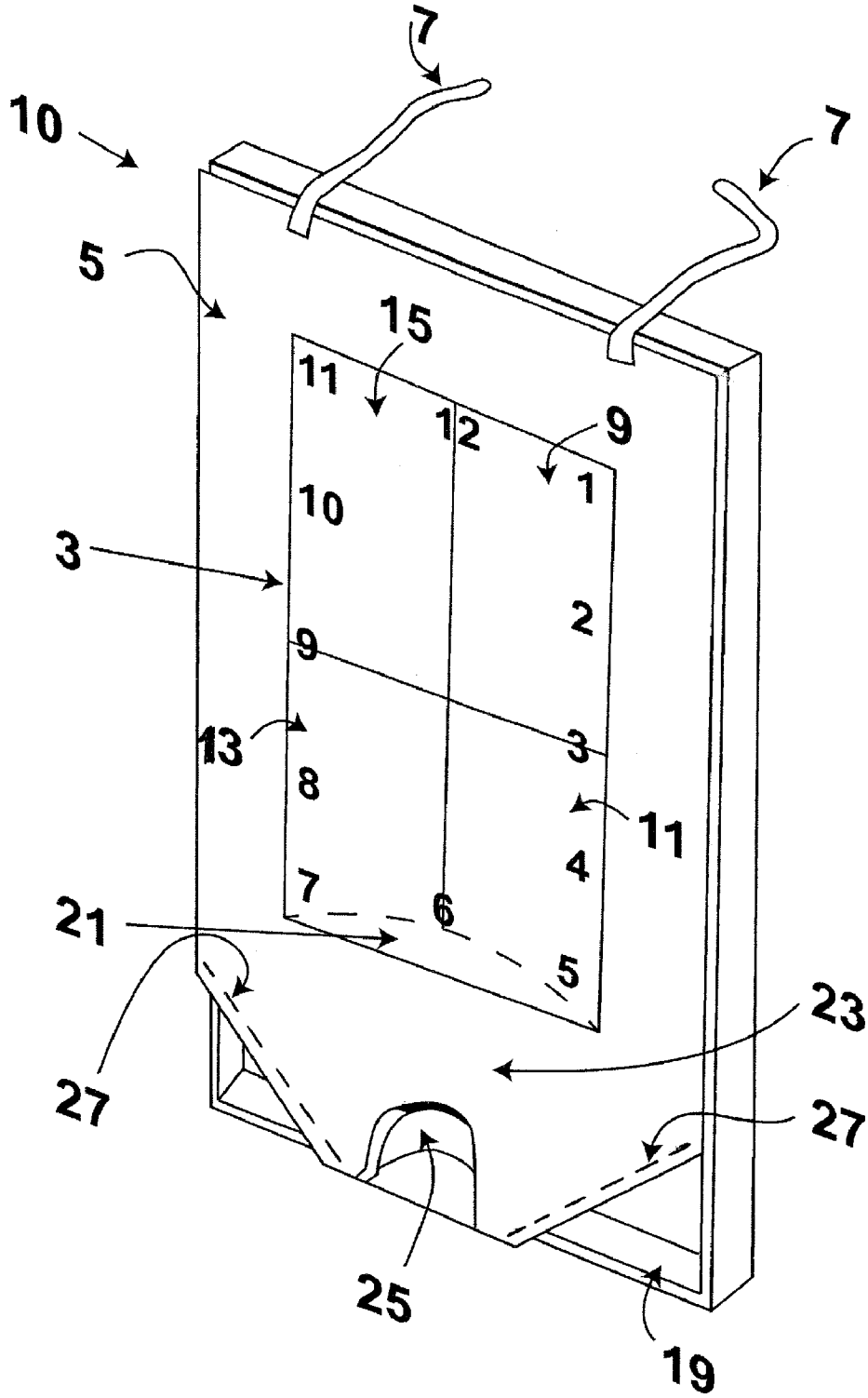
FIG. 3 shows a perspective view of another alternate embodiment of a device comprising a target area useful in accordance with the invention.

In FIG. 3 is shown a perspective view of another alternate embodiment of a device 10 useful in accordance with the present invention and comprising a target area 3. In this embodiment, the target area 3 may be disposed on a separate sheet of material from the backing 5 and affixed thereto, or the target area features may be directly affixed, printed, etc to the backing 5 as previously described. In this embodiment, there is an opening 21 through the surface of the backing 5 that is disposed at the lower edge portion of the target area. One way to accomplish this is to take a single sheet of material from which the backing 5 is comprised, and to cut a slit, corresponding to the location of the opening 21. Then, the target area features are next disposed on the backing 5 directly, or a separate sheet comprising the target area features can be affixed to the backing. There is no preferred order to the sequence of providing a device 10 according to this embodiment. The backing 5 has a rear layer 19 affixed to its rear surface by conventional means, which may include stitching 27 around common peripheral edges of the backing 5 and the rear layer 19. Thus, the rear layer is disposed on the rear side of the backing 5, which rear side of the backing is the opposite side of the backing that has the target area 3 disposed on its face, which is the front surface of the backing. The rear layer 19 may be any material or construct hereinbefore described as being useful for the backing 5, including a piece of foamed polymer or the like that is encased in a fabric or any other capsule known in the art as being capable of housing slabs of foamed materials. There are preferably stitches 27 or other means of adhering the rear layer 19 and the backing 5 to one another in a construction having the fashion or means outlined in FIG. 3, so as to define an inner cavern between the rear layer 19 and the backing 5, that is below the opening 21. Thus, there is a pocket cover area 23 of the backing 5, which functions as one of the walls of the cavern. Such an arrangement enables a ball that is thrown at the target area to fall into the opening 21, and be retrieved by the thrower or their helper at the retrieval opening 25, which is a hole disposed through the backing 5. Optionally, the retrieval opening may include a floor portion, which can be a piece of fabric, polymer sheet or the like that is attached to either the backing 5 or rear layer 19 in any fashion.

Figure 4:
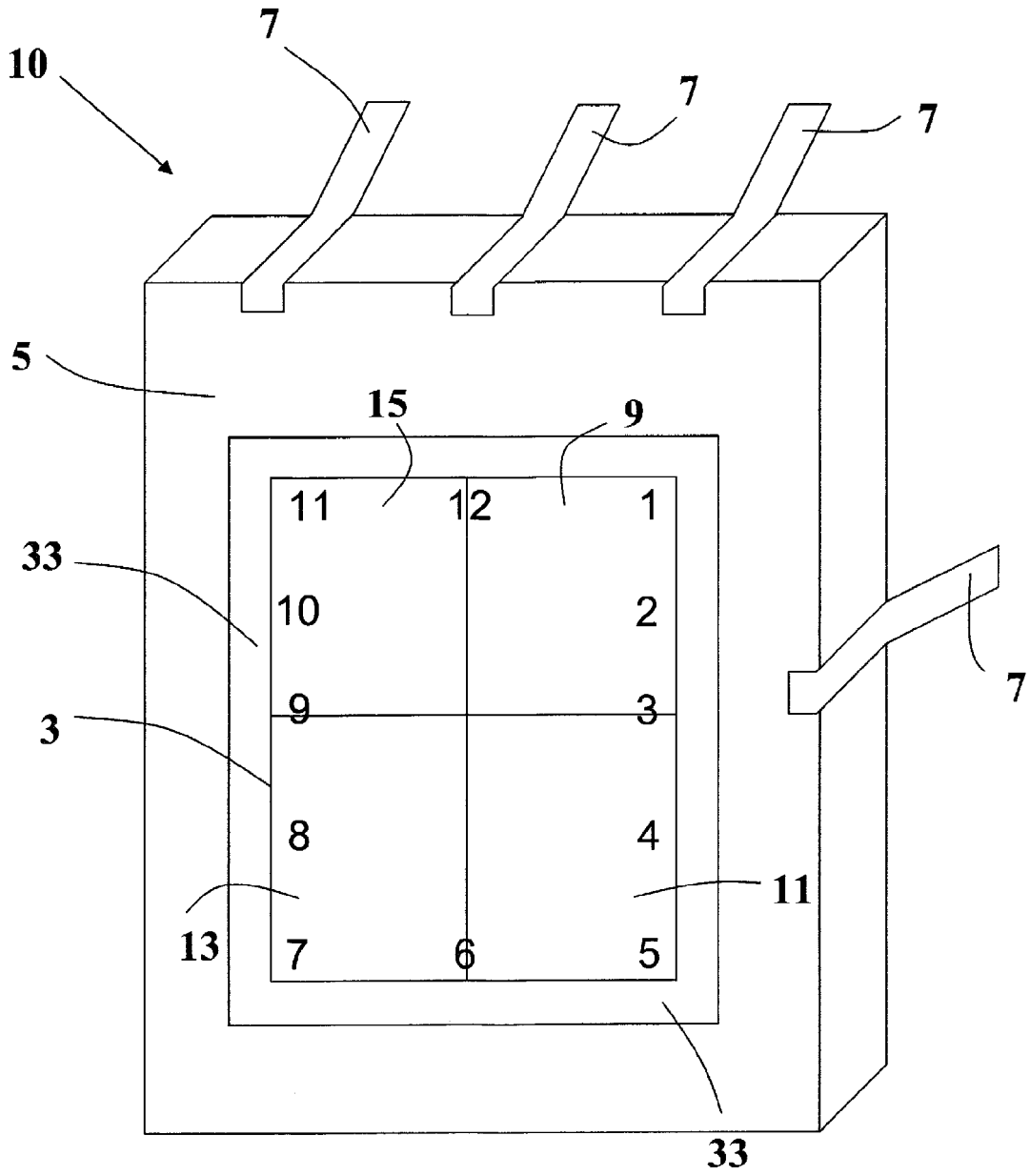
FIG. 4 shows a perspective view of another alternate embodiment of a device comprising a target area useful in accordance with the invention.

FIG. 4 shows a perspective view of an alternate embodiment of a device 10 comprising a target area useful in accordance with the invention. In this embodiment are shown the respective locations of the target area 3, backing 5, first quadrant 9, second quadrant 11, third quadrant 13, and fourth quadrant 15. There are also a plurality of straps 7 disposed around the perimeter of the backing 5. The backing 5 may comprise a piece of fabric, such as made from natural fibers including without limitation cottons, linens, burlap, hemp, and the like, and may also comprise sheets of polymeric materials, woven or non-wovens, including polyolefins, nylons, and other known sheet materials. The backing may also be paper or cardboard. Thus, the backing 5 may be comprised of the same material as the target area 3. In other embodiments, the backing 5 and target area 3 may each be independently comprised of materials which are different from one another within the aforesaid class of materials. In one embodiment, the sheet or fabric on which the target area features are painted, printed, adhered etc. is different from that of the backing. In another embodiment, the target area features are painted, printed, adhered directly to the backing 5. The grommets 17 provide an easy means for tying or fastening the device 10 to a stationary object. The backing 5 may in any embodiment herein may comprise the outer surface of a cushion or pillow, or a sheathing containing a cushion, pillow, or pillow-like construction. In the embodiment shown in FIG. 4, there is also depicted a border region 33 disposed about the target area 3. The border region is a region having a different color then the remaining portion of the backing 5. In one preferred embodiment, the color of the border region 33 is gray, although any color which contrasts sufficiently with the remaining portion of the backing 5 and the target area 3 to a viewer disposed at about 27.43 meters (about 90 feet) from the article 10 is adequate, the number of possible color combinations being quite large, as one of ordinary skill recognizes after having read the instant specification.

As mentioned, the various quadrants need to comprise colors or shades which are sufficient to enable a person to distinguish between adjacent quadrants. Suitable colors for each quadrant to be independently selected from include all known colors of the visible spectrum, which also includes all different shades and tints thereof. In one preferred embodiment, the first quadrant 9 is blue, the second quadrant 11 is black, the third quadrant 13 is green and the fourth quadrant 15 is red.

As mentioned, in use, a device 10 according to the invention is affixed to a stationary object, such as a fence, in a disposition which places the target area 3 in a location corresponding to where the strike zone would be in a real or practice baseball game. Then, a person who desires to use a device according to the invention, which we can refer to as the student, locates themselves at any desired distance from the device 10, which distance may or may not correspond to the distance between a batter and a pitcher in a baseball game setting.

In one embodiment of a process according to the invention, the student first looks at the target area 3 in a first glancing step. Then, the student looks away from the target area, at any other object within their visually-observable surroundings, in a resting glance step, e.g. they may look to the sky, a spectator seating area, or other players. The idea here is to change the focusing of the eye's iris for a moment. Then the student once again glances at the target area in a second glancing step. In the second glancing step, the student may look directly at the same location on the target area that they had looked at in the first glancing step such as one of the individual characters which are disposed about the periphery of the target area. Alternatively, the student may look at a different location on the target area that they had looked at in the first glancing step such as a different individual character that is disposed about the periphery of the target area. By initially focusing at one portion of the periphery of the strike zone, resting the glance by looking elsewhere sufficiently to enable the iris to refocus, and subsequently looking back at the same or a different character or number on the periphery of the target area 3, a student can increase their cognizance of the location of the strike zone, versus methods of practicing baseball pitching known in the art in which one merely visualized a strike zone. A process according to the invention provides a type of eye exercise that is not available in the art, inasmuch as it combines the sporting activity of pitching baseballs with quasi-formal ocular exercises.

SIMULATED GAMES

An article according to an embodiment the invention ("the pad") may be used in conjunction with simulated games that may be played during training sessions to help improve overall performance of the player(s). Below are instructions and suggestions for using an article according to an embodiment of the invention in such simulated games.

Objective: To make it through the determined number of innings without allowing a run to score. The number of innings for a particular game is decided by the players. If there are multiple players, they can be divided into teams. The team with the lowest number of runs scored wins. In the event of a tie, the team with the lowest number of base runners wins. There are three levels of play.

Level One:

1. The player must strike out three "hitters" before allowing any runs in the inning.
2. If a player cannot strike the "hitter" out, then the "hitter" is walked and becomes a ghost runner.
3. Once the player has struck out three "hitters", the inning is over and any "hitters" that the player walked are removed from the imaginary bases.
4. The player must throw the ball inside the strike zone, for it to be counted as a strike.

Level Two:

1. All of the rules above apply at this level, except for these changes.
2. A strike is determined by hitting a specific color with the pitch (red, blue, green, black). The color is chosen before the pitch is made, either by the pitcher or by an apposing player.
3. If the pitcher fails to hit the specific color, then it is called a ball.
4. If the player misses the pad completely or throws the ball into the dirt, that is considered a wild pitch and any runners on base automatically advance one base.

Level Three:

1. All of the rules above apply at this level, except for these changes.
2. A strike is determined by hitting a specific number with the pitch. The number is chosen before the pitch is made, either by the pitcher or by an opposing player.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. This includes subject matter defined by any combination of any one of the various claims appended hereto with any one or more of the remaining claims, including the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. This also includes combination of the features and/or limitations of one or more of the independent claims with features and/or limitations of another independent claims to arrive at a modified independent claim, with the remaining dependent claims in their original text being read and applied to any independent claim so modified. Additionally, the features of any embodiment described herein may be applied, affixed, or incorporated, as is applicable, to any other embodiment herein described. Accordingly, the presently disclosed invention is intended to cover all such modifications and alterations, and is limited only by the scope of the claims which follow.

I claim:

1. An article used as a training aid for pitching projectiles such as baseballs comprising:

a backing having a front layer and a rear layer, and a target layer positioned on said front layer of the backing;

wherein said front layer includes a first opening disposed rearwardly of said target layer and extending to a lower edge of said corresponding target layer, and a second opening disposed at a lower edge of the front and rear layer of the backing;

the target layer having a periphery, wherein the lower edge of said target layer periphery includes a slit;

a pair of sectioning lines disposed on a front surface of said target layer for dividing said front surface into four substantially equal quadrants, said sectioning lines being reminiscent in orientation about said target layer to crosshairs on a rifle scope, each of said quadrants having a background color that is sufficiently different from adjacent quadrants to provide an effective amount of contrast to enable a user to visually distinguish between the different quadrants from a distance within a throwing ability of said user; and a plurality of characters disposed about the outer periphery of said target layer, wherein said characters are selected from the group consisting of: numbers, letters, symbols, signs, and geometric shapes, and wherein each selected character is arranged clockwise in an ascending order on said front surface of said target layer;

wherein said target layer is vertically adjustable; and wherein said front and rear layers are operationally configured to define an inner cavern between said front and rear layers, said inner cavern being in communication with both said first and second openings, wherein when said target layer is impacted by a pitched ball the lower edge of said target layer moves inwardly into said first opening, and wherein a pitched ball can enter said first opening and exit through said second opening.

2. The article according to claim 1, further comprising: d) a backing to which said target area is attached.

3. The article according to claim 2 wherein said backing includes a means for attachment of said backing to a stationary object.

4. The article according to claim 1, further comprising:

d) a border region disposed around said target area, wherein said border region is of a contrasting color with respect to the colors of said quadrants and the remaining portion of the backing.

5. The article according to claim 1, which includes means for attachment of said article to a stationary object.

6. The article of claim 1, wherein the characters are Arabic-style numbers arranged as on a common clock face.

7. The article of claim 1, wherein each quadrant includes at least two characters thereon.

8. The article of claim 1, wherein said sectioning lines include at least four characters thereon.

9. The article of claim 1, wherein the characters are Arabic-style numbers arranged as on a common clock face.

* * * * *